US011341898B2

(12) United States Patent
Yue et al.

(10) Patent No.: US 11,341,898 B2
(45) Date of Patent: May 24, 2022

(54) PIXEL DRIVING CIRCUIT, PIXEL DRIVING METHOD AND DISPLAY DEVICE

(71) Applicant: BOE TECHNOLOGY GROUP CO., LTD., Beijing (CN)

(72) Inventors: Han Yue, Beijing (CN); Minghua Xuan, Beijing (CN); Ning Cong, Beijing (CN); Xiaochuan Chen, Beijing (CN); Can Zhang, Beijing (CN); Can Wang, Beijing (CN); Ming Yang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 309 days.

(21) Appl. No.: 16/605,384

(22) PCT Filed: Mar. 26, 2019

(86) PCT No.: PCT/CN2019/079727
§ 371 (c)(1),
(2) Date: Oct. 15, 2019

(87) PCT Pub. No.: WO2019/228033
PCT Pub. Date: Dec. 5, 2019

(65) Prior Publication Data

US 2021/0358389 A1 Nov. 18, 2021

(30) Foreign Application Priority Data

May 29, 2018 (CN) ..... 201810534285.5

(51) Int. Cl.
*G09G 3/32* (2016.01)

(52) U.S. Cl.
CPC ..... *G09G 3/32* (2013.01); *G09G 2300/0426* (2013.01); *G09G 2300/0852* (2013.01); *G09G 2330/023* (2013.01)

(58) Field of Classification Search
CPC ..... G09G 3/32; G09G 2300/0852; G09G 2330/023; G09G 2300/0426;
(Continued)

(56) References Cited

U.S. PATENT DOCUMENTS 8,922,462 B2 * 12/2014 Tomida ..... G09G 3/2092 345/76
9,953,583 B2 * 4/2018 Yoon ..... G09G 3/3233
(Continued)

FOREIGN PATENT DOCUMENTS

CN 107437401 A 12/2017
CN 108538240 A 9/2018

OTHER PUBLICATIONS

International Search Report of PCT/CN2019/079727 in Chinese, dated Jun. 28, 2019, with English translation.

*Primary Examiner* — Vijay Shankar
(74) *Attorney, Agent, or Firm* — Collard & Roe, P.C.

(57) ABSTRACT

A pixel driving circuit, a pixel driving method and a display device are provided. The pixel driving circuit includes a pixel sub-circuit and a power supply control sub-circuit, the pixel sub-circuit includes a first connection terminal, a second connection terminal and a light-emitting element, and is configured to respectively receive a first voltage and a second voltage to drive the light-emitting element to emit light. The power supply control sub-circuit is configured to, in a first state, control the first power supply terminal to provide the first voltage to the first connection terminal of the pixel sub-circuit, control the second power supply terminal to provide the second voltage to the second connection terminal of the pixel sub-circuit, and store energy; and in a second state, release the energy to the first connection terminal and the second connection terminal of the pixel sub-circuit to drive the light-emitting element to emit light.

19 Claims, 14 Drawing Sheets

(58) Field of Classification Search
CPC ..... G09G 2310/0262; G09G 2330/02; G09G 2330/028
See application file for complete search history.

(56) References Cited

U.S. PATENT DOCUMENTS

| | | | | |
|---|---|---|---|---|
| 10,937,840 | B2 * | 3/2021 | Lee | H01L 51/5246 |
| 2016/0005384 | A1 | 1/2016 | Yoon et al. | |
| 2017/0345369 | A1 | 11/2017 | Lai et al. | |
| 2019/0333446 | A1 * | 10/2019 | Yin | G09G 3/3266 |
| 2020/0410927 | A1 * | 12/2020 | Wang | G09G 3/3275 |
| 2021/0241664 | A1 * | 8/2021 | Li | G09G 3/006 |

* cited by examiner

PIXEL DRIVING CIRCUIT, PIXEL DRIVING METHOD AND DISPLAY DEVICE

CROSS REFERENCE TO RELATED APPLICATIONS

This application is the National Stage of PCT/CN2019/079727 filed on Mar. 26, 2019, which claims priority under 35 U.S.C. § 119 of Chinese Application No. 201810534285.5 filed on May 29, 2018, the disclosure of which is incorporated by reference.

TECHNICAL FIELD

Embodiments of the present disclosure relate to a pixel driving circuit, a pixel driving method and a display device.

BACKGROUND

Micro Light-Emitting Diodes (Micro-LED) display devices are one of hotspots in a field of display research, and have advantages, such as high brightness, ultra-high resolution, color saturation, independent driving of each pixel, fast response speed, and the like.

SUMMARY

At least one embodiment of the present disclosure provides a pixel driving circuit, which includes a pixel sub-circuit and a power supply control sub-circuit, the pixel sub-circuit includes a first connection terminal, a second connection terminal and a light-emitting element, and is configured to respectively receive a first voltage and a second voltage from the first connection terminal and the second connection terminal to drive the light-emitting element to emit light; the power supply control sub-circuit is respectively coupled to the first connection terminal, the second connection terminal, a first power supply terminal, and a second power supply terminal; and the power supply control sub-circuit is configured to, in a first state, control the first power supply terminal to provide the first voltage to the first connection terminal of the pixel sub-circuit, and control the second power supply terminal to provide the first voltage and the second voltage to the first connection terminal and the second connection terminal of the pixel sub-circuit respectively, and store energy; and in a second state, release the energy to the first connection terminal and the second connection terminal of the pixel sub-circuit to drive the light-emitting element light.

In some examples, the pixel sub-circuit includes an input sub-circuit, a first storage sub-circuit and a driving sub-circuit; the input sub-circuit is respectively coupled to a scan signal terminal, a data signal terminal and a first node, and is configured to provide a signal of the data signal terminal to the first node under control of the scan signal terminal; the first storage sub-circuit is coupled to the first node and is configured to store the signal of the data signal terminal received by the first node; the driving sub-circuit is respectively coupled to the first node, a second node and a third node, and is configured to provide a driving current, which is used for driving the light-emitting element, to the third node under control of the first node; the light-emitting element is respectively coupled to the third node and a fourth node; and the first connection terminal and the second connection terminal are respectively coupled to the second node and the fourth node.

In some examples, the power supply control sub-circuit further includes a control sub-circuit, a power supply sub-circuit and a switching sub-circuit; the control sub-circuit is respectively coupled to the first power supply terminal, the second power supply terminal, a first control terminal, a second control terminal, the fourth node and a fifth node, and is configured to, in the first state, provide the first voltage from the first power supply terminal to the fifth node under control of the first control terminal, and provide the second voltage from the second power supply terminal to the fourth node under control of the second control terminal; the power supply sub-circuit is respectively coupled to the second node and the fifth node, and is configured to store the energy in the first state and release the stored energy in the second state to drive the light-emitting element to emit light; and the switching sub-circuit is respectively coupled to the fourth node and the fifth node, and is configured to switch off in the first state or switch on in the second state under control of the fourth node and the fifth node.

In some examples, the control sub-circuit includes a first control sub-circuit and a second control sub-circuit, the first control sub-circuit is coupled to the first power supply terminal, the fifth node and the first control terminal, and is configured to, in the first state, provide the first voltage from the first power supply terminal to the fifth node under control of the first control terminal; and the second control sub-circuit is coupled to the second power supply terminal, the fourth node and the second control terminal, and is configured to, in the first state, provide the second voltage from the second power supply terminal to the fourth node under control of the second control terminal.

In some examples, the pixel driving circuit further includes a second storage sub-circuit; the second storage sub-circuit is respectively coupled to the third node and the fourth node, and is configured to store a voltage difference between the third node and the fourth node.

In some examples, the input sub-circuit includes a first switching transistor; a control electrode of the first switching transistor is coupled to the scan signal terminal, a first electrode of the first switching transistor is coupled to the data signal terminal, and a second electrode of the first switching transistor is coupled to the first node; the first storage sub-circuit includes a first capacitor; a first terminal of the first capacitor is coupled to the first node, and a second terminal of the first capacitor is coupled to the second node; the driving sub-circuit includes a driving transistor; and a control electrode of the driving transistor is coupled to the first node, a first electrode of the driving transistor is coupled to the second node, and a second electrode of the driving transistor is coupled to the third node.

In some examples, the control sub-circuit includes a second switching transistor and a third switching transistor; a control electrode of the second switching transistor is coupled to the first control terminal, a first electrode of the second switching transistor is coupled to the first power supply terminal, and a second electrode of the second switching transistor is coupled to the fifth node; and a control electrode of the third switching transistor is coupled to the second control terminal, a first electrode of the third switching transistor is coupled to the fourth node, and a second electrode of the third switching transistor is coupled to the second power supply terminal.

In some examples, the power supply sub-circuit includes an inductor; and a first terminal of the inductor is coupled to the fifth node, and a second terminal of the inductor is coupled to the second node.

In some examples, the switching sub-circuit includes a diode; and an anode of the diode is coupled to the fourth node, and a cathode of the diode is coupled to the fifth node.

In some examples, the second storage sub-circuit includes a second capacitor; and a first terminal of the second capacitor is coupled to the third node, and a second terminal of the second capacitor is coupled to the fourth node.

In some examples, the pixel driving circuit further includes a second storage sub-circuit, wherein the input sub-circuit includes a first switching transistor; the first storage sub-circuit includes a first capacitor; the driving sub-circuit includes a driving transistor; the power supply control sub-circuit includes a second switching transistor, an inductor, a third switching transistor and a diode; and the second storage sub-circuit includes a second capacitor; a control electrode of the first switching transistor is coupled to the scan signal terminal, a first electrode of the first switching transistor is coupled to the data signal terminal, and a second electrode of the first switching transistor is coupled to the first node; a first terminal of the first capacitor is coupled to the first node, and a second terminal of the first capacitor is coupled to the second node; a control electrode of the driving transistor is coupled to the first node, a first electrode of the driving transistor is coupled to the second node, and a second electrode of the driving transistor is coupled to the third node; a control electrode of the second switching transistor is coupled to the first control terminal, a first electrode of the second switching transistor is coupled to the first power supply terminal, and a second electrode of the second switching transistor is coupled to the fifth node; a first terminal of the inductor is coupled to the fifth node, and a second terminal of the inductor is coupled to the second node; a control electrode of the third switching transistor is coupled to the second control terminal, a first electrode of the third switching transistor is coupled to the fourth node, and a second electrode of the third switching transistor is coupled to the second power supply terminal; an anode of the diode is coupled to the fourth node, and a cathode of the diode is coupled to the fifth node; and a first terminal of the second capacitor is coupled to the third node, and a second terminal of the second capacitor is coupled to the fourth node.

In some examples, the light-emitting element includes a micro light-emitting diode.

At least one embodiment of the present disclosure also provides a display device, which includes the above pixel driving circuit.

At least one embodiment of the present disclosure also provides a pixel driving method, which is applied to the pixel driving circuit, and the pixel driving method includes: in the first state, providing the first voltage and the second voltage respectively to the first connection terminal and the second connection terminal of the pixel sub-circuit, by the first power supply terminal and the second power supply terminal, and storing the energy, by the power supply control sub-circuit; and in the second state, releasing the energy to the first connection terminal and the second connection terminal of the pixel sub-circuit, by the power supply control sub-circuit, to drive the light-emitting element to emit light.

In some examples, in a case where the power supply control sub-circuit is coupled to a first control terminal and a second control terminal respectively, the driving method further includes: in the first state, providing turn-on signals to the first control terminal and the second control terminal to allow the first power supply terminal to provide the first voltage to the first connection terminal of the pixel driving circuit, to allow the second power supply terminal to provide the second voltage to the second connection terminal of the pixel driving circuit, and to allow the power supply control sub-circuit to store the energy; and in the second state, providing turn-off signals to the first control terminal and the second control terminal to allow the power supply control sub-circuit to release the energy to the first connection terminal and the second connection terminal of the pixel driving circuit to drive the light-emitting element to emit light.

In some examples, in a case where the pixel sub-circuit includes an input sub-circuit, the input sub-circuit is respectively coupled to a scan signal terminal, a data signal terminal and a first node, and is configured to provide a signal of the data signal terminal to the first node under control of the scan signal terminal; the driving method further includes: providing a turn-on signal to the scan signal terminal to allow the signal of the data signal terminal to be provided to the first node; and signals provided to the first control terminal and the second control terminal are same and are periodic signals, and periods of the periodic signals are less than a duration of the turn-on signal provided to the scan signal terminal.

BRIEF DESCRIPTION OF THE DRAWINGS

In order to clearly illustrate the technical solutions of the embodiments of the present disclosure, the drawings of the embodiments will be briefly described in the following; it is obvious that the described drawings are only related to some embodiments of the present disclosure and thus are not limitative to the present disclosure.

DETAILED DESCRIPTION

Figure 1:
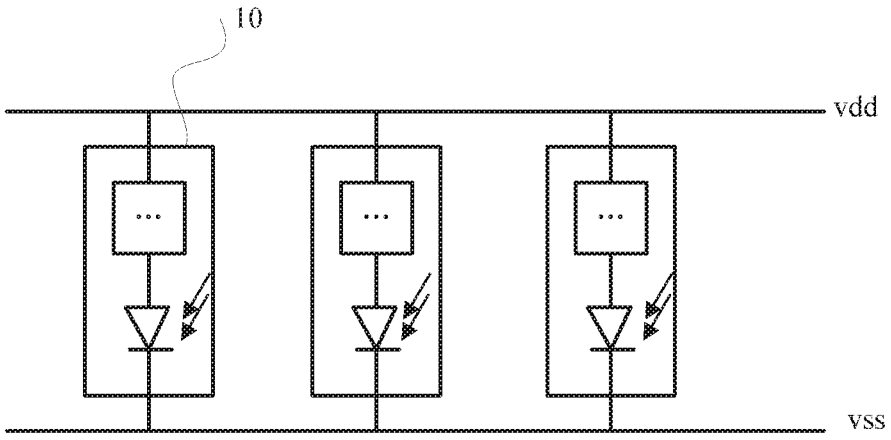
FIG. 1 is a schematic diagram of traces in a display device.

In order to make objects, technical details and advantages of the embodiments of the present disclosure apparent, the technical solutions of the embodiments will be described in a clearly and fully understandable way in connection with the drawings related to the embodiments of the present disclosure. Apparently, the described embodiments are just a part but not all of the embodiments of the present disclosure. Based on the described embodiments herein, those skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. Also, the terms such as "a," "an," etc., are not intended to limit the amount, but indicate the existence of at least one. The terms "comprise," "comprising," "comprise," "including," etc., are intended to specify that the elements or the objects stated before these terms encompass the elements or the objects and equivalents thereof listed after these terms, but do not preclude the other elements or objects. The phrases "connect", "coupled", etc., are not intended to define a physical connection or mechanical connection, but may comprise an electrical connection, directly or indirectly. "On," "under," and the like are only used to indicate relative position relationship, and when the absolute position of the object which is described is changed, the relative position relationship may be changed accordingly.

Those skilled in the art can understand that a switching transistor and a driving transistor used in all embodiments of the present application can be thin film transistors or field effect transistors or other devices with same characteristics. Transistors used in some embodiments of the present disclosure may be oxide semiconductor transistors. Because a source electrode and a drain electrode of the switching transistor used here are symmetrical, the source electrode and the drain electrode can be interchanged. In some embodiments of the present disclosure, in order to distinguish the two electrodes of the switching transistor except a gate electrode, one of the two electrodes is referred to as a first electrode and the other electrode is referred to as a second electrode, the first electrode may be the source electrode or the drain electrode, the second electrode may be the drain electrode or the source electrode, and the gate electrode is referred to as a control electrode.

A pixel driving circuit is a core technology of a display device. Each sub-pixel has a pixel driving circuit to control a current flowing through a light-emitting element (such as a Micro-LED). In a conventional pixel driving circuit, a high voltage power supply and a low voltage power supply are required to be provided to two terminals of a light-emitting element of each sub-pixel. In a light-emitting stage of the light-emitting element, a current always exists in a trace between the high voltage power supply and the low voltage power supply.

Research by the inventors found that in a case where the light-emitting element is a Micro-LED, due to a large display brightness, the current required to flow through the Micro-LED is large, so that an electric energy loss of the trace between the high voltage power supply and the low voltage power supply is large and cannot be ignored, thus causing a waste of electric energy. FIG. 1 is a schematic diagram of traces in a display device. As shown in FIG. 1, the display device includes a plurality of pixel driving circuits 10, each pixel driving circuit is configured to provide a driving current for a Micro-LED of each sub-pixel, and a high voltage signal vdd and a low voltage signal vss are respectively applied to two terminals of the Micro-LED of each sub-pixel. In a traditional pixel driving circuit, the high voltage signal and the low voltage signal are output from a printed circuit hoard and transmitted to two terminals of the Micro-LED through traces, the traces always have currents in the light-emitting stage of the Micro-LED, and an average power consumption P of the traces in a time period t1-t2 meets the following requirements:

$$P(t) = \frac{\int_{t1}^{t2} I(t)^2 Rt}{t2 - t1}$$

where I(t) is an instantaneous current flowing through the trace, R is a resistance of the trace, and t is the time which I(t) flows through the trace.

Because there is always current in the trace, the average power consumption of the trace is a constant and satisfies $P=I^2R$.

The pixel driving circuit, which controls the Micro-LED, provides a large driving current to the Micro-LED, and the average power consumption of the trace is proportional to the instantaneous current flowing through the trace, so the average power consumption of the trace is large and cannot be ignored, thereby resulting in the waste of electric energy.

In order to reduce the average power consumption of the traces between the high voltage power supply and the low voltage power supply, and save the electric energy, some embodiments of the present disclosure provide a pixel driving circuit, a pixel driving method, and a display device.

Figure 2A:
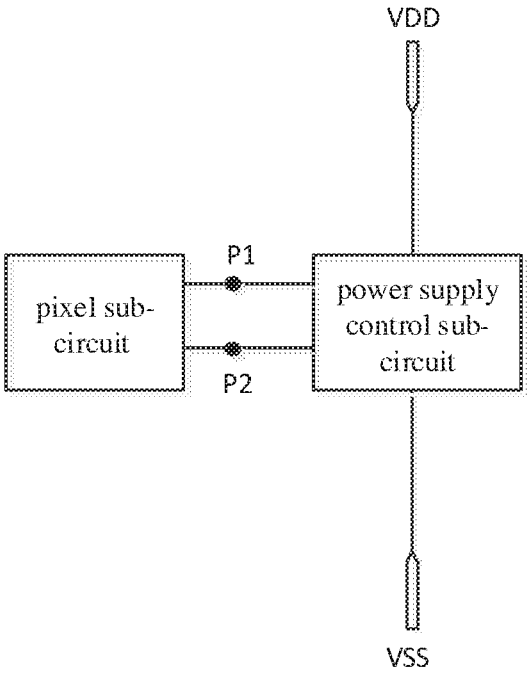
FIG. 2A is a schematic diagram of a pixel driving circuit provided by some embodiments of the present disclosure.

FIG. 2A is a structural schematic diagram of a pixel driving circuit provided by some embodiments of the present disclosure. As shown in FIG. 2A, the pixel driving circuit provided by some embodiments of the present disclosure includes a pixel sub-circuit and a power supply control sub-circuit. The pixel sub-circuit includes a first connection terminal P1 and a second connection terminal P2, and is configured to respectively receive a first voltage and a second voltage from the first connection terminal Pt and the second connection terminal P2, to drive a light-emitting element (not shown) emit light. The power supply control sub-circuit s respectively coupled to the first connection terminal P1 and the second connection terminal P2, and is also coupled to a first power supply terminal VDD and a second power supply terminal VSS. The power supply control sub-circuit is configured to, in a first state, control the first power supply terminal VDD to provide the first voltage to the first connection terminal P1 of the pixel sub-circuit, control the second power supply terminal VSS to provide the second voltage to the second connection terminal P2 of the pixel sub-circuit, and store energy; and in a second state, release the energy to the first connection terminal P1 and the second connection terminal P2 of the pixel sub-circuit to drive the light-emitting element to emit light.

A specific structure of the pixel sub-circuit is not limited to the embodiment of the present disclosure. For example, the pixel sub-circuit may be any driving circuit that drives the light-emitting element to emit light, such as a conventional 2T1C (i.e., two transistors and one capacitor) pixel circuit, and in different embodiments, the pixel sub-circuit may further include a compensation circuit, which includes an internal compensation circuit or an external compensation circuit, and the compensation circuit may include transistors, capacitors, etc. For example, the pixel sub-circuit may further include a reset circuit, a light-emitting control circuit, a detection circuit, and the like as required.

A specific structure of the power supply control sub-circuit is not limited to the embodiment of the present disclosure. For example, the power supply control sub-circuit may store the energy provided by the first power supply terminal and the second power supply terminal in the first state, and in the second state, the power supply control sub-circuit may release the energy to drive the light-emitting element to emit light, in place of the first power supply terminal and the second power supply terminal. For example, the power supply control sub-circuit includes an energy storage element.

In the second state, the power supply control sub-circuit serves as a power supply to release the energy to the pixel sub-circuit to drive the light-emitting element to emit light, and no current needs to flow through a power supply trace to drive the light-emitting element to emit light, thus reducing the electric energy loss of the trace and saving the electric energy.

The specific structure of the pixel sub-circuit and the specific structure of the power supply control sub-circuit provided by some embodiments of the present disclosure are exemplarily described below.

Figure 2B:
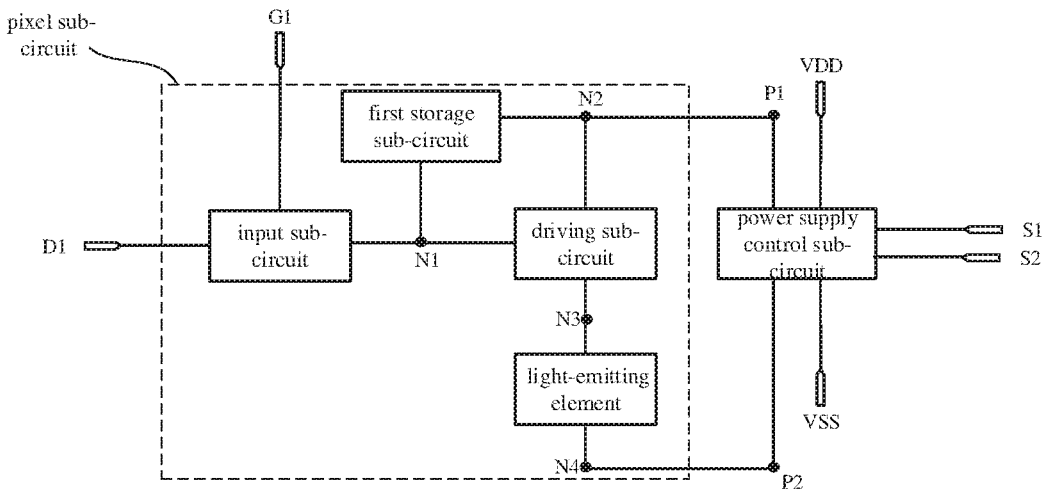
FIG. 2B is a first structural schematic diagram of a pixel driving circuit provided by some embodiments of the present disclosure.

FIG. 2B is a first structural schematic diagram of a pixel driving circuit provided by some embodiments of the present disclosure. As shown in FIG. 2B, in the pixel driving circuit provided by some embodiments of the present disclosure, the pixel sub-circuit includes an input sub-circuit, a first storage sub-circuit, a driving sub-circuit and a light-emitting element.

In this embodiment, the input sub-circuit is respectively coupled to a scan signal terminal G1, a data signal terminal D1 and a first node N1, and is configured to provide a signal of the data signal terminal D1 to the first node N1 under control of the scan signal terminal G1; the first storage sub-circuit is coupled to the first node N1, and is configured to store the signal of the data signal terminal D1 received by the first node N1; the driving sub-circuit is respectively coupled to the first node N1, a second node N2 and a third node N3, is configured to provide a driving current, which is used for driving the light-emitting element, to the third node N3 under control of the first node N1; the light-emitting element is respectively coupled to the third node N3 and a fourth node N4. The power supply control sub-circuit is respectively coupled to the first power supply terminal VDD, a first control terminal S1, the second node N2, the second power supply terminal VSS, a second control terminal S2 and the fourth node N4, and is configured to, in the first state, provide a signal of the first power supply terminal VDD to the second node N2 under control of the first control terminal S1, provide a signal of the second power supply terminal VSS to the fourth node N4 under control of the second control terminal S2, and store the energy between the first power supply terminal VDD and the second node N2; and the power supply control sub-circuit is further configured to, in the second state, release the stored energy to drive the light-emitting element to emit light.

For example, as shown in FIG. 2B, the first connection terminal P1 of the pixel sub-circuit is coupled to the second node N2, and the second connection terminal P2 of the pixel sub-circuit is coupled to the fourth node N4.

For example, the first storage sub-circuit is also coupled to the second node N2. In other examples, the first storage sub-circuit may also be coupled to the third node N3 or grounded, which is not limited to the embodiment of the present disclosure.

For example, the light-emitting element includes a micro light-emitting diode (Micro-LED). For example, a size of the micro light-emitting diode in at least one direction is less than 100 microns.

It should be noted that the first power supply terminal VDD continuously provides a high-level signal and the second power supply terminal VSS continuously provides a low-level signal. The scan signal terminal G1 is specifically a scan line, the data signal terminal D1 is specifically a data line, and the scan signal terminal G1 and the data signal terminal D1 provide pulse signals.

In this embodiment, the power supply control sub-circuit is used to control a current flowing through a trace between the first power supply terminal and the second power supply terminal under control of the first control terminal and the second control terminal, so as to reduce the time when the current flows through the trace, reduce the electric energy loss of the trace, and save the electric energy.

The pixel driving circuit provided by some embodiments of the present disclosure includes an input sub-circuit, a first storage sub-circuit, a driving sub-circuit and a light-emitting element, and further includes a power supply control sub-circuit. The input sub-circuit is respectively coupled to a scan signal terminal, a data signal terminal and a first node, and is configured to provide a signal of the data signal terminal to the first node under control of the scan signal terminal. The first storage sub-circuit is coupled to the first node and a second node, and is configured to store a voltage difference between the first node and the second node. The driving sub-circuit is respectively coupled to the first node, the second node and a third node, and is configured to provide a driving current, which is used for driving the light-emitting element, to the third node under control of the first node. The light-emitting element is respectively coupled to the third node and a fourth node. The power supply control sub-circuit is respectively coupled to the first power supply terminal, a first control terminal, the second node, the second power supply terminal, a second control terminal and the fourth node, and is configured to, in the first state, provide a signal of the first power supply terminal to the second node under control of the first control terminal S1, provide a signal of the second power supply terminal to the fourth node under control of the second control terminal, and store the energy between the first power supply terminal and the second node; and in the second state, release the stored energy to drive the light-emitting element to emit light under control of the first control terminal and the second control terminal. Some embodiments of the present disclosure control the current flowing through the trace between the first power supply terminal and the second power supply terminal by providing the power supply control sub-circuit, which can reduce the time when the current flows through the trace between the high voltage power supply and the low voltage power supply, thereby reducing the electric energy loss of the trace and saving the electric energy.

Figure 3A:
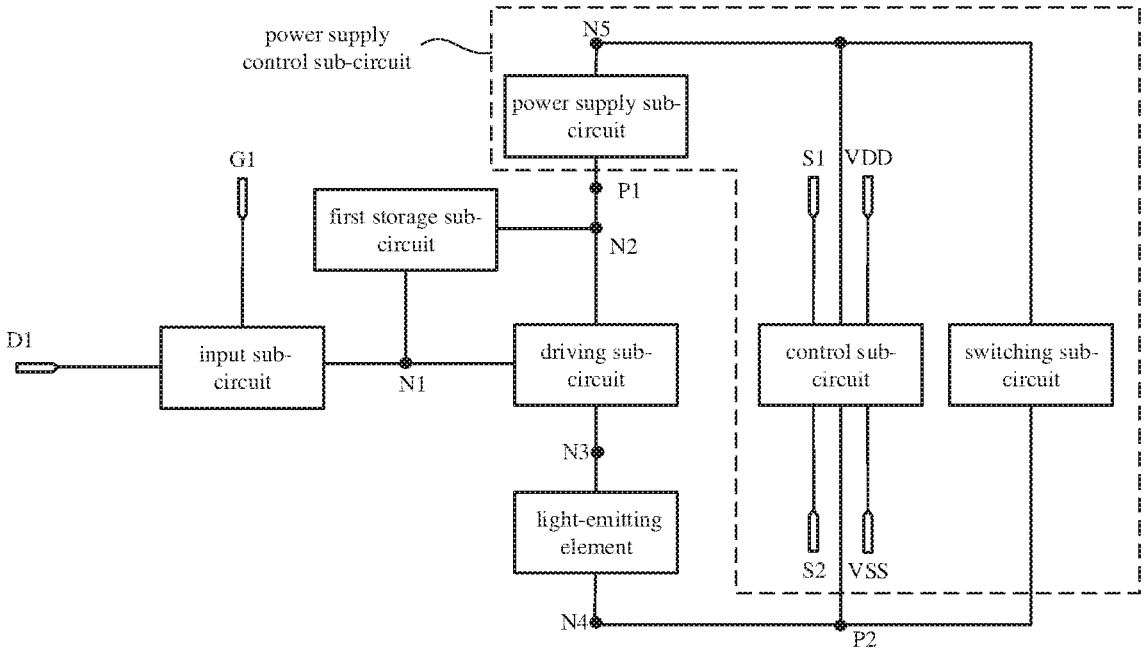
FIG. 3A is a second structural schematic diagram of a pixel driving circuit provided by some embodiments of the present disclosure.

For example, FIG. 3A is a second structural schematic diagram of a pixel driving circuit provided by some embodiments of the present disclosure. As shown in FIG. 3A, the power supply control sub-circuit in the pixel driving circuit provided by some embodiments of the present disclosure includes a control sub-circuit, a power supply sub-circuit, and a switching sub-circuit.

In this embodiment, the control sub-circuit is respectively coupled to the first power supply terminal VDD, the second power supply terminal VSS, the first control terminal S1, the second control terminal S2, the fourth node N4 and a fifth node N5, and is configured to, in the first state, provide the signal of the first power supply terminal VDD to the fifth node N5 under control of the first control terminal S1, and provide the signal of the second power supply terminal VSS to the fourth node N4 under control of the second control terminal S2. The power supply sub-circuit is respectively coupled to the second node N2 and the fifth node N5, and is configured to store the energy in the first state, and release the stored energy to drive the light-emitting element to emit light in the second state. The switching sub-circuit is respectively coupled to the fourth node N4 and the fifth node N5, and is configured to switch off in the first state or switch on in the second state under control of the fourth node N4 and the fifth node N5.

Figure 3B:
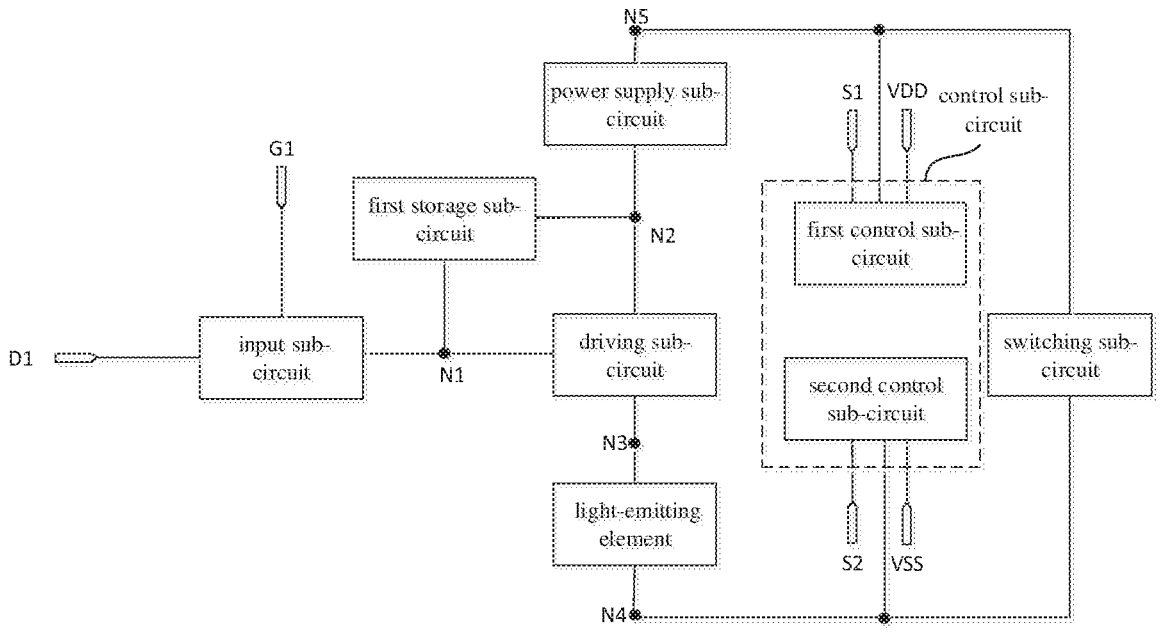
FIG. 3B is a structural schematic diagram of another pixel driving circuit provided by some embodiments of the present disclosure.

In an example, the control sub-circuit includes a first control sub-circuit and a second control sub-circuit. As shown in FIG. 3B, the first control sub-circuit is coupled to the first power supply terminal VDD, the fifth node N5, and the first control terminal S1, and the second control sub-circuit is coupled to the second power supply terminal VSS, the fourth node N4, and the second control terminal S2.

For example, the first control sub-circuit is configured to, in the first state, provide the first voltage from the first power supply terminal VDD to the fifth node N5 under control of the first control terminal S1. The second control sub-circuit is coupled to the second power supply terminal VSS, the fourth node N4 and the second control terminal S2, and is configured to, provide the second voltage from the second power supply terminal VSS to the fourth node N4 under control of the second control terminal S2 in the first state.

In the second state, the control sub-circuit is switched off under control of the first control terminal S1 and the second control terminal S2, thereby cutting off signal transmission between the first power supply terminal VDD and the fifth node N5 and signal transmission between the second power supply terminal VSS and the fourth node. Therefore, in this second state, there is no current flowing through the power supply trace to drive the light-emitting element to emit light, thereby reducing the electric energy loss of the trace and saving the electric energy.

Figure 4:
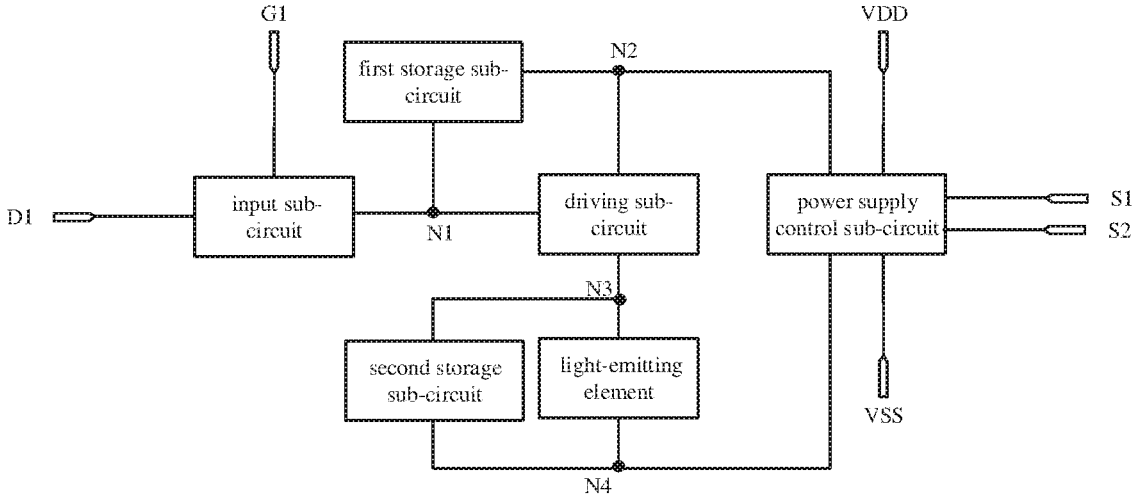
FIG. 4 is a third structural schematic diagram of a pixel driving circuit provided by some embodiments of the present disclosure.

For example, FIG. 4 is a third structural schematic diagram of a pixel driving circuit provided by some embodiments of the present disclosure. As shown in FIG. 4, the pixel driving circuit provided by some embodiments of the present disclosure further includes a second storage sub-circuit.

The second storage sub-circuit is respectively coupled to the third node N3 and the fourth node N4, and is configured to store a voltage difference between the third node N3 and the fourth node N4.

For example, some embodiments of the present disclosure maintain a stable voltage output by providing the second storage sub-circuit.

Figure 5:
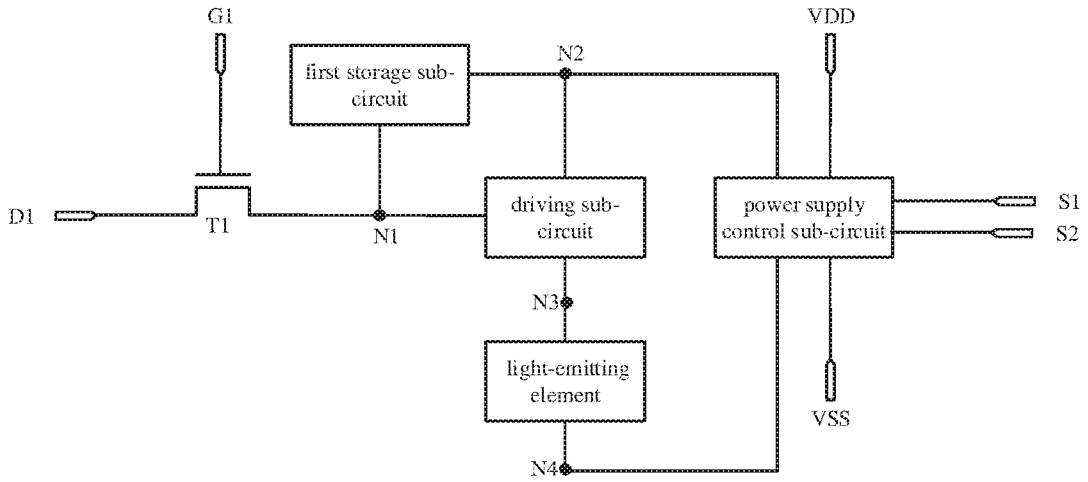
FIG. 5 is an equivalent circuit diagram of an input sub-circuit provided by some embodiments of the present disclosure.

For example, FIG. 5 is an equivalent circuit diagram of an input sub-circuit provided by some embodiments of the present disclosure. As shown in FIG. 5, the input sub-circuit includes a first switching transistor T1.

For example, a control electrode of the first switching transistor T1 is coupled to the scan signal terminal G1, a first electrode of the first switching transistor T1 is coupled to the data signal terminal D1, and a second electrode of the first switching transistor T1 is coupled to the first node N1.

It should be noted that an exemplary structure of the input sub-circuit is specifically shown in FIG. 5. Those skilled in the art readily understand that the implementation of the input sub-circuit is not limited to this case, as long as its function can be realized.

Figure 6:
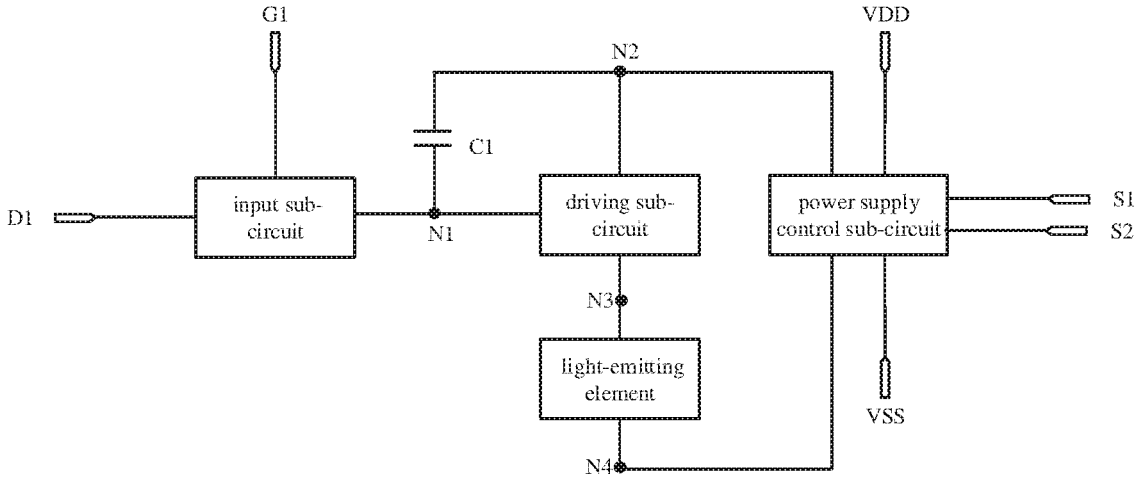
FIG. 6 is an equivalent circuit diagram of a first storage sub-circuit provided by some embodiments of the present disclosure.

For example, FIG. 6 is an equivalent circuit diagram of a first storage sub-circuit provided by some embodiments of the present disclosure. As shown in FIG. 6, the first storage sub-circuit includes a first capacitor C1.

For example, a first terminal of the first capacitor C1 is coupled to the first node N1, and a second terminal of the first capacitor C1 is coupled to the second node N2.

It should be noted that an exemplary structure of the first storage sub-circuit is specifically shown in FIG. 6. Those skilled in the art readily understand that the implementation of the first storage sub-circuit is not limited to this case, as long as its function can be realized.

Figure 7:
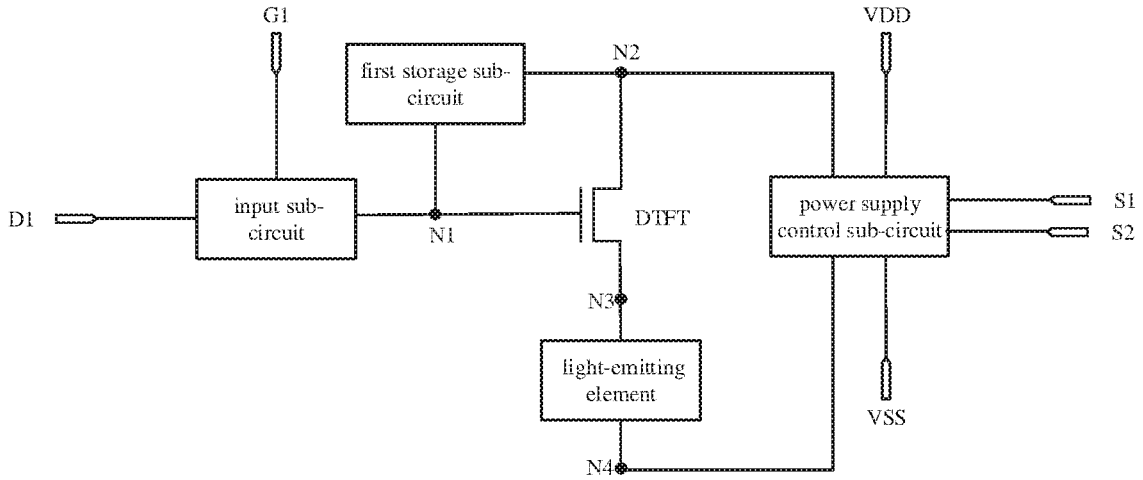
FIG. 7 is a structural schematic diagram of a driving sub-circuit provided by some embodiments of the present disclosure.

For example, FIG. 7 is an equivalent circuit diagram of a driving sub-circuit provided by some embodiments of the present disclosure. As shown in FIG. 7, the driving sub-circuit includes a driving transistor DTFT.

For example, a control electrode of the driving transistor DTFT is coupled to the first node N1, a first electrode of the driving transistor DTFT is coupled to the second node N2, and a second electrode of the driving transistor DTFT is coupled to the third node N3.

It should be noted that an exemplary structure of the driving sub-circuit is specifically shown in FIG. 7. Those skilled in the art readily understand that the implementation of the driving sub-circuit is not limited to this case, as long as its function can be realized.

Figure 8:
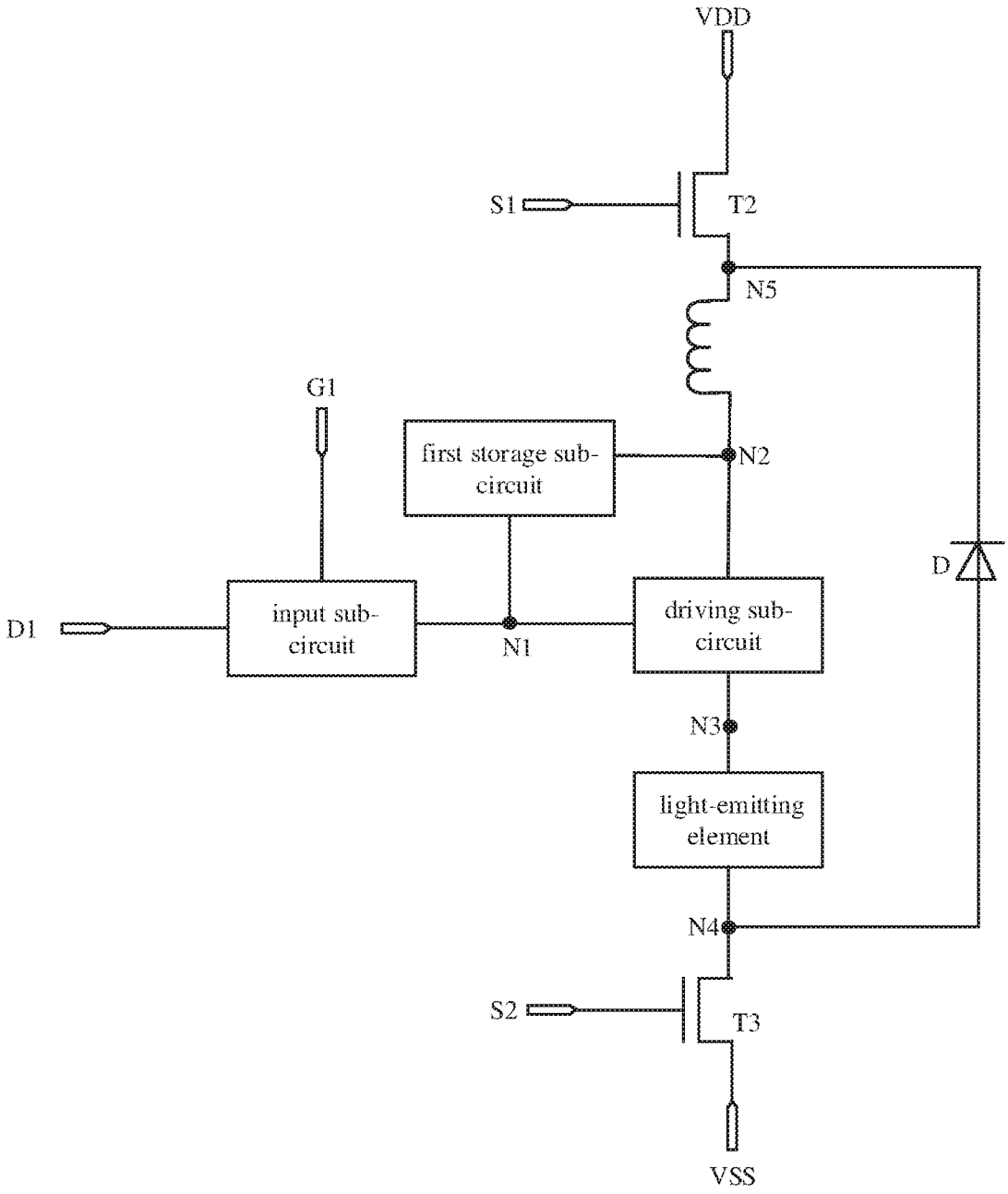
FIG. 8 is a structural schematic diagram of a power supply control sub-circuit provided by some embodiments of the present disclosure.

For example, FIG. 8 is an equivalent circuit diagram of a power supply control sub-circuit provided by some embodiments of the present disclosure. As shown in FIG. 8, the power supply control sub-circuit includes a control sub-circuit, a power supply sub-circuit and a switching sub-circuit.

For example, the control sub-circuit includes a second switching transistor T2 and a third switching transistor T3.

For example, the power supply sub-circuit includes an energy storage element; for example, the energy storage element is an inductor L.

For example, the switching sub-circuit includes a unidirectional conduction element, an anode of the unidirectional conduction element is coupled to the fourth node N4, and a cathode of the unidirectional conduction element is coupled to the fifth node N5. For example, the unidirectional conduction element is a diode D.

For example, a control electrode of the second switching transistor T2 is coupled to the first control terminal S1, a first electrode of the second switching transistor T2 is coupled to the first power supply terminal VDD, and a second electrode of the second switching transistor T2 is coupled to the fifth node N5. A first terminal of the inductor L is coupled to the fifth node N5, and a second terminal of the inductor L is coupled to the second node N2. A control electrode of the third switching transistor T3 is coupled to the second control terminal S2, a first electrode of the third switching transistor T3 is coupled to the fourth node N4, and a second electrode of the third switching transistor T3 is coupled to the second power supply terminal VSS. An anode of the diode D is coupled to the fourth node N4, and a cathode of the diode D is coupled to the fifth node N5.

In this embodiment, the second switching transistor T2 and the third switching transistor T3 are switched on or switched off at the same time. In a case where the second switching transistor T2 and the third switching transistor T3 are switched on at the same time, the inductor L stores the energy. Because a potential of the fourth node N4 is lower than a potential of the fifth node N5, the diode D is in a turn-off state. In a case where the second switching transistor T2 and the third switching transistor T3 are switched off at the same time, in this situation, the inductor L releases the stored energy, and because the potential of the fourth node N4 is higher than the potential of the fifth node N5, the diode D is in a turn-on state.

It should be noted that an exemplary structure of the power supply control sub-circuit is specifically shown in FIG. 8. Those skilled in the art readily understand that the implementation of the power supply control sub-circuit is not limited to this case, as long as its function can be realized.

Figure 9:
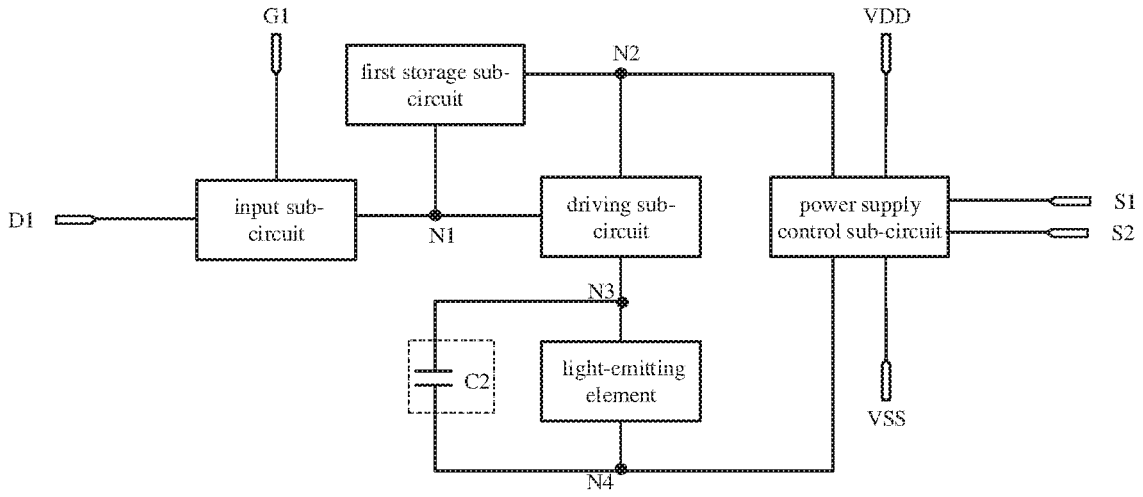
FIG. 9 is an equivalent circuit diagram of a second storage sub-circuit provided by some embodiments of the present disclosure.

For example, FIG. 9 is an equivalent circuit diagram of a second storage sub-circuit provided by some embodiments of the present disclosure. As shown in FIG. 9, the second storage sub-circuit includes a second capacitor C2.

For example, a first terminal of the second capacitor C2 is coupled to the third node N3, and a second terminal of the second capacitor C2 is coupled to the fourth node N4.

It should be noted that an exemplary structure of the second storage sub-circuit is specifically shown in FIG. 9. Those skilled in the art readily understand that the implementation of the second storage sub-circuit is not limited to this case, as long as its function can be realized.

Figure 10:
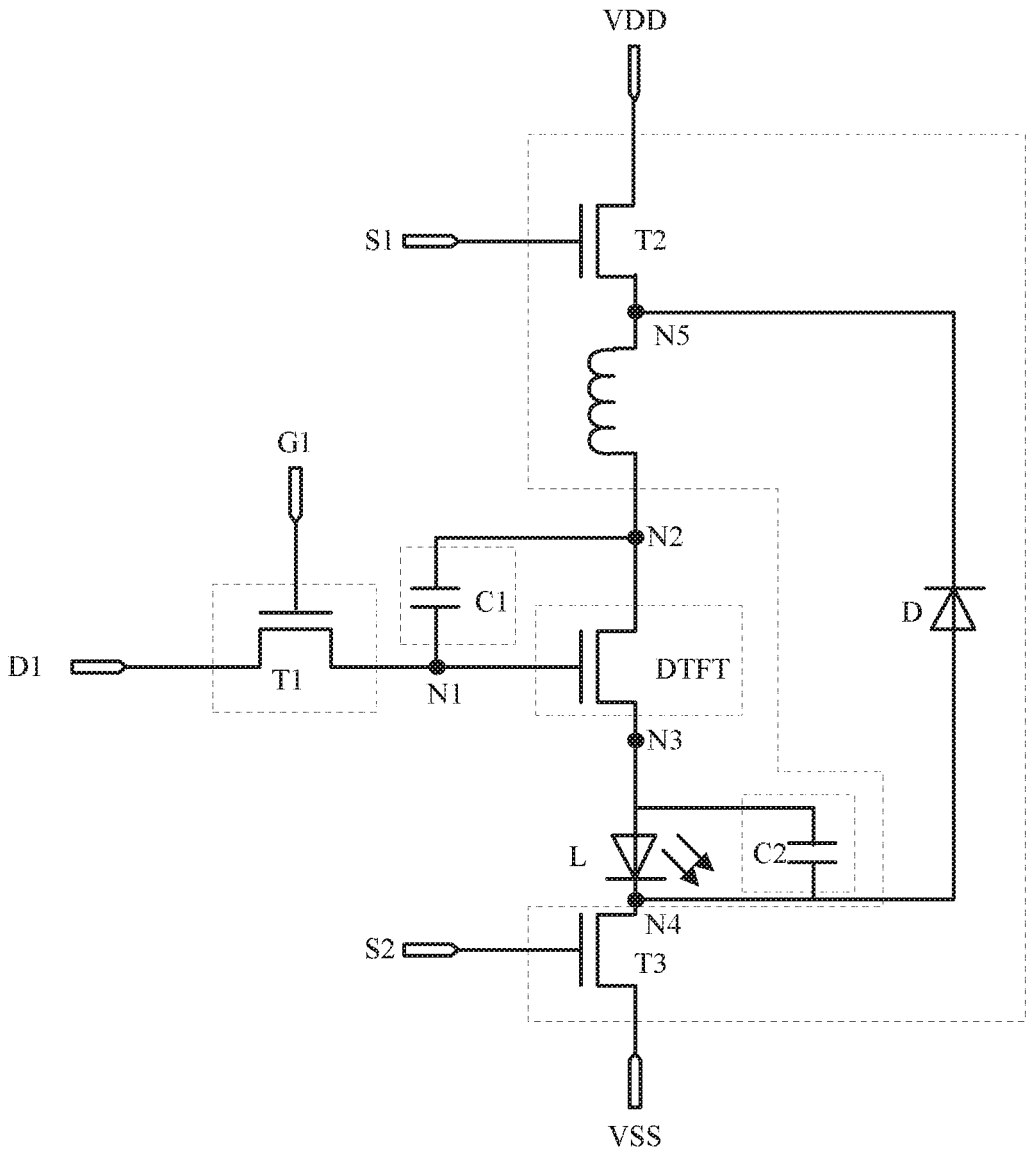
FIG. 10 is an equivalent circuit diagram of a pixel driving circuit provided by some embodiments of the present disclosure.

For example, FIG. 10 is an equivalent circuit diagram of pixel driving circuit provided by some embodiments of the present disclosure. As shown in FIG. 10, the pixel driving circuit further includes a second storage sub-circuit. The input sub-circuit includes a first switching transistor T1; the first storage sub-circuit includes a first capacitor C1; the driving sub-circuit includes a driving transistor DTFT; the power supply control sub-circuit includes a second switching transistor T2, an inductor L, a third switching transistor T3 and a diode D; and the second storage sub-circuit includes a second capacitor C2.

For example, a control electrode of the first switching transistor T1 is coupled to the scan signal terminal G1, a first electrode of the first switching transistor T1 is coupled to the data signal terminal D1, and a second electrode of the first switching transistor T1 is coupled to the first node N1; a first terminal of the first capacitor C1 is coupled to the first node N1, and a second terminal of the first capacitor C1 is coupled to the second node N2; a control electrode of the driving transistor DTFT is coupled to the first node N1, a first electrode of the driving transistor DTFT is coupled to the second node N2, and a second electrode of the driving transistor DTFT is coupled to the third node N3; a control electrode of the second switching transistor T2 is coupled to the first control terminal S1, a first electrode of the second switching transistor T2 is coupled to the first power supply terminal VDD, and a second electrode of the second switching transistor T2 is coupled to the fifth node N5; a first terminal of the inductor L is coupled to the fifth node N5, and a second terminal of the inductor L is coupled to the second node N2; a control electrode of the third switching transistor T3 is coupled to the second control terminal S2, a first electrode of the third switching transistor T3 is coupled to the fourth node N4, and a second electrode of the third switching transistor T3 is coupled to the second power supply terminal VSS; an anode of the diode D is coupled to the fourth node N4, and a cathode of the diode D is coupled to the fifth node N5; and a first terminal of the second capacitor C2 is coupled to the third node N3, and a second terminal of the second capacitor C2 is coupled to the fourth node N4.

It should be noted that in this embodiment, the driving transistor DTFT, the first switching transistor T1, the second switching transistor T2, and the third switching transistor T3 are all N-type thin film transistors or P-type transistors, which can unify the process flow, reduce the process flow of the display device, and help to improve the yield of products.

In addition, in a case where a type of the second switching transistor T2 is identical to a type of the third switching transistor T3, an input signal of the first control terminal S1 and an input signal of the second control terminal S2 in some embodiments of the present disclosure are same and are periodic signals, periods of the periodic signals are less than a duration of a pulse of the scan signal terminal G1.

The following further illustrates the technical scheme of some embodiments of the present disclosure through the operation process of the pixel driving circuit.

Figure 11:
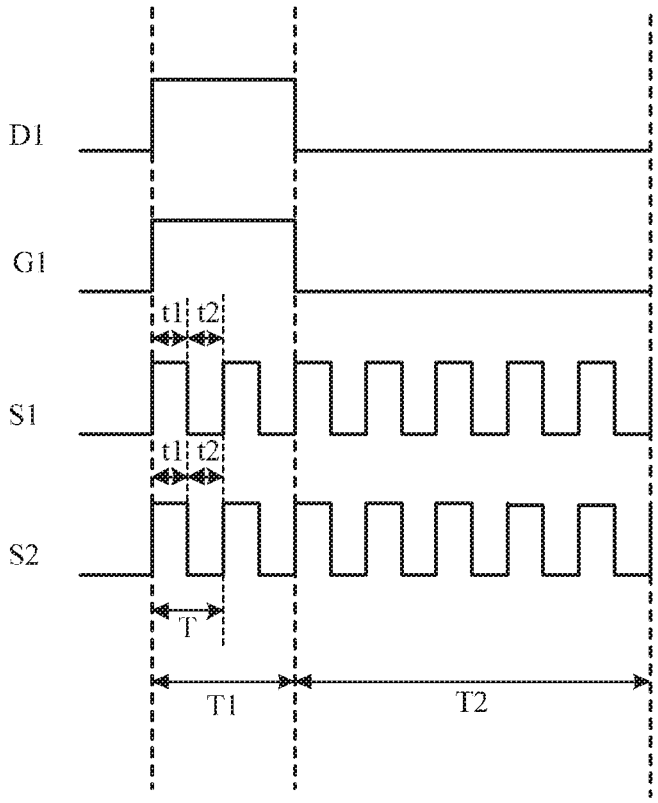
FIG. 11 is an operation timing diagram of a pixel driving circuit provided by some embodiments of the present disclosure.
Figure 12:
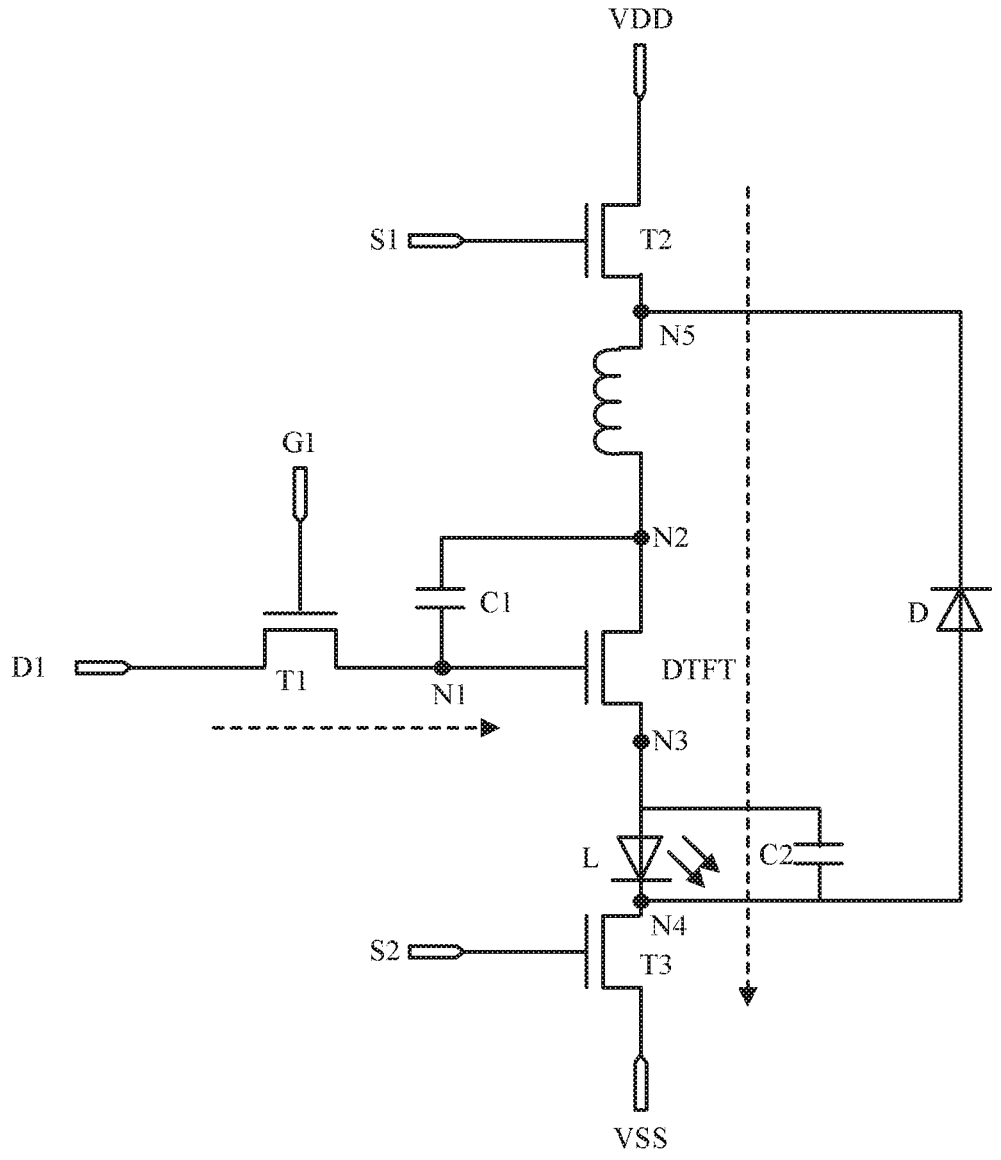
FIG. 12 is a first schematic diagram of a writing stage of a pixel driving circuit provided by some embodiments of the present disclosure.
Figure 13:
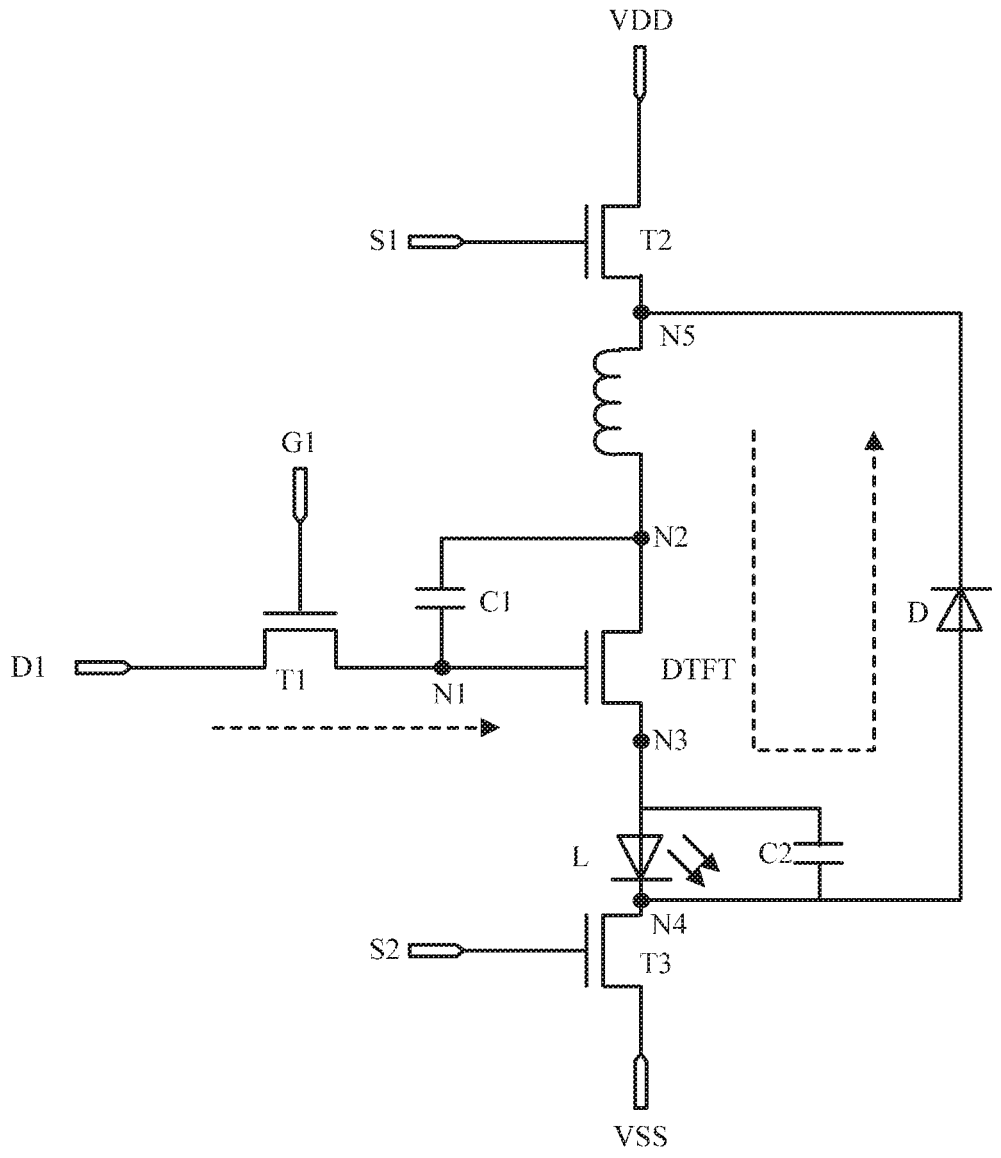
FIG. 13 is a second schematic diagram of a writing stage of a pixel driving circuit provided by some embodiments of the present disclosure.
Figure 14:
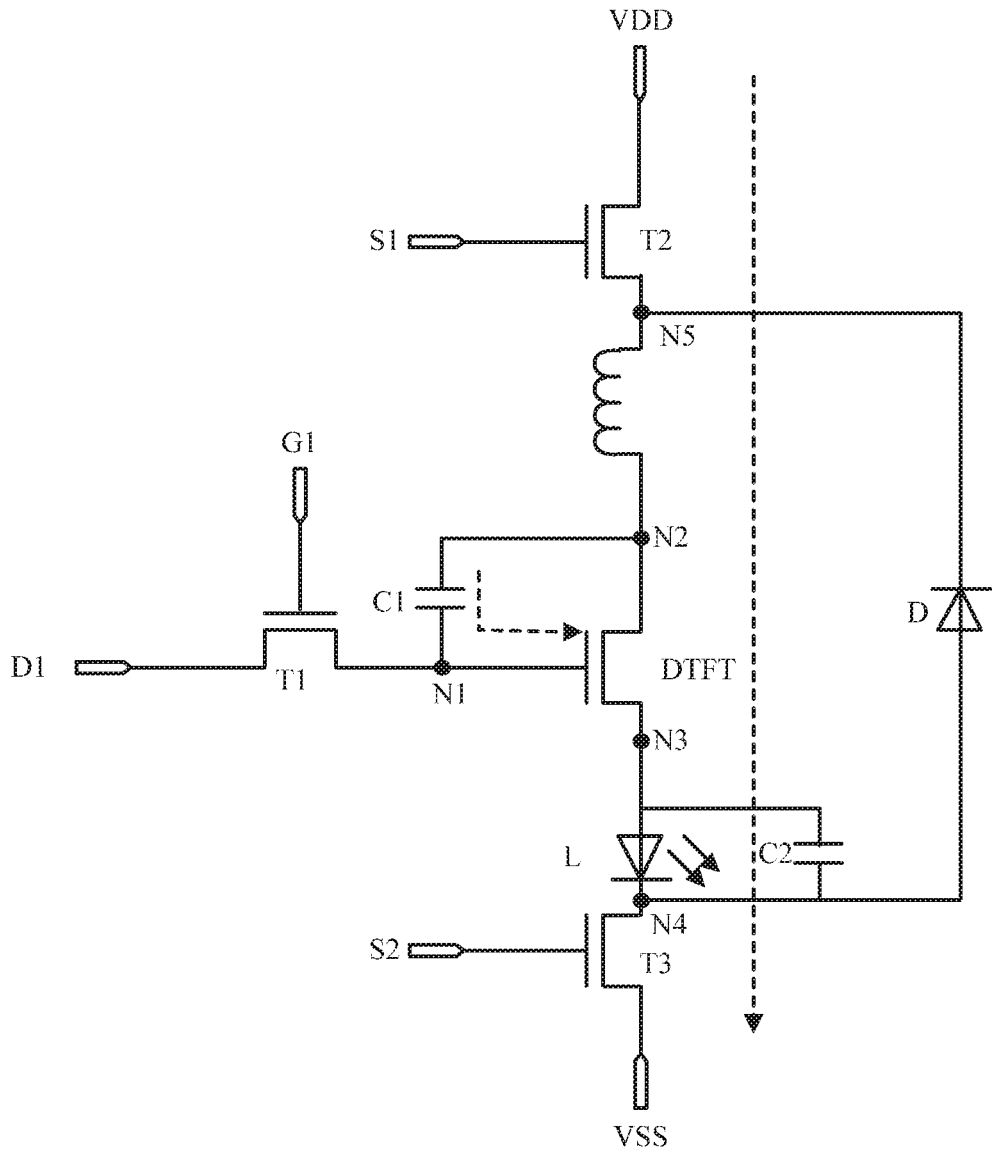
FIG. 14 is a first schematic diagram of a holding stage of a pixel driving circuit provided by some embodiments of the present disclosure.
Figure 15:
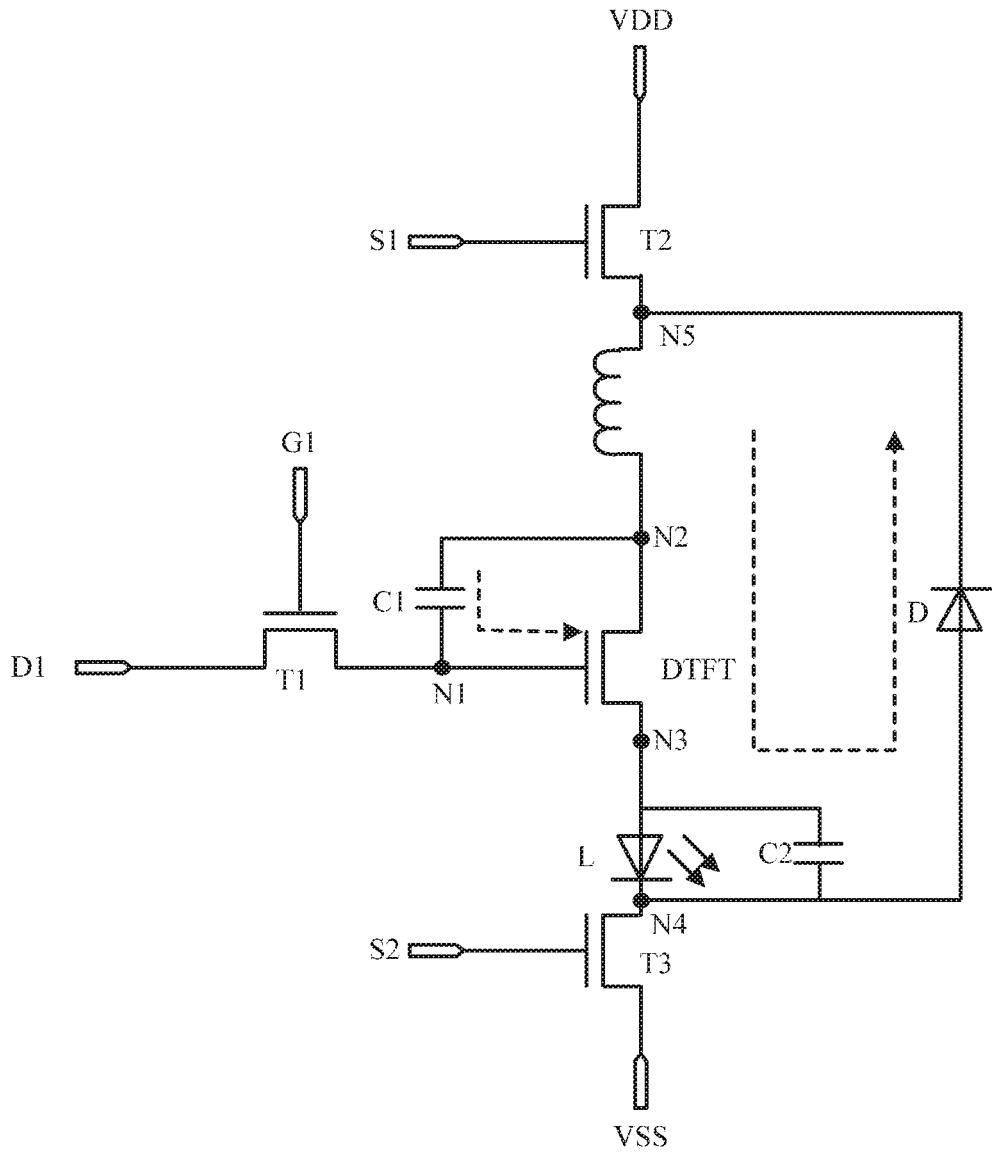
FIG. 15 is a second schematic diagram of a holding stage of a pixel driving circuit provided by some embodiments of the present disclosure.

It is taken as an example that the transistors T1 to T3 and DTFT in the pixel driving circuit provided by some embodiments of the present disclosure are N-type transistors, FIG. 11 is an operation timing chart of the pixel driving circuit provided by some embodiments of the present disclosure; FIG. 12 is a first schematic diagram of a writing stage of a pixel driving circuit provided by some embodiments of the present disclosure; FIG. 13 is a second schematic diagram of a writing stage of a pixel driving circuit provided by some embodiments of the present disclosure. FIG. 14 is a first schematic diagram of a holding stage of a pixel driving circuit provided by some embodiments of the present disclosure. FIG. 15 is a second schematic diagram of a holding stage of a pixel driving circuit provided by some embodiments of the present disclosure. As shown in FIGS. 10-15, the pixel driving circuit provided by some embodiments of the present disclosure includes three switching transistor units (T1-T3), one driving transistor (DTFT), two capacitance units (C1 and C2), and four input terminals (D1, G1, S1 and S2). The operation process of the pixel driving circuit includes, for example, a first stage T1 and a second stage T2.

For example, the first power supply terminal VDD continuously provides a high-level signal; and the second power supply terminal VSS continuously provides a low-level signal.

For example, in the first stage T1, that is, the writing stage, an input signal of the scan signal terminal G1 is at a high level, and the first switching transistor T1 is switched on; the input signal of the data signal terminal D1 is at a high level, and the input signal of the data signal terminal D1 is provided to the first node N1, the first capacitor C1 is charged, and the driving transistor DTFT is switched on.

For example, the first stage T1 includes a plurality of first sub-stages a and second sub-stages t2.

For example, in the first sub-stage t1, turn-on signals are input to the first control terminal S1 and the second control terminal S2 to switch on the first switching transistor T1 and the second switching transistor T2. For example, the input signal of the first control terminal S1 is at a high level, the second switching transistor T2 is switched on, and the signal of the first power supply terminal VDD is provided to the fifth node N5. The input signal of the second control terminal S2 is at a high level, and the third switching transistor T3 is switched on. The signal of the second power supply terminal VSS is provided to the fourth node N4, and the inductor L stores the energy. Because the potential of the fifth node N5 is higher than the potential of the fourth node N4, the diode D is in a turn-off state. In this situation, the second switching transistor T2-the inductor L-the driving transistor DTFT-the micro light-emitting diode L-the third switching transistor T3 form a conductive path, and the micro light-emitting diode L emits light.

For example, in the second sub-stage t2, the input signal of the first control terminal S1 and the input signal of the second control terminal S2 are at a low level, the second switching transistor T2 and the third switching transistor T3 are switched off, the inductor L releases the energy stored in the first sub-stage to the second node N2, and because the potential of the fifth node N5 is lower than the potential of the fourth node N4, the diode D is in a turn-on state. In this situation, the inductor L-the driving transistor DTFT-the micro light-emitting diode L-the diode D forms a closed conductive path, and the inductor L releases the energy to the second node N2 and the fourth node N4 to drive the micro light-emitting diode L to emit light.

It should be noted that FIG. 11 is described by taking a case, that the first stage T1 includes two first sub-stages a and two second sub-stages t2, as an example. Some embodiments of the present disclosure may also include one first sub-stage and one second sub-stage, and some embodiments of the present disclosure are not limited thereto.

For example, in the second stage T2, that is, the holding stage, the input signal of the scan signal terminal G1 is at a low level, the first switching transistor T1 is switched off, and the first capacitor C1 continuously increases a potential of the first node N1 under a bootstrap effect, so as to keep the driving transistor DTFT on.

For example, the second stage T2 includes a plurality of first sub-stages a and second sub-stages t2.

For example, in the first sub-stage t1, the input signal of the first control terminal S1 is at a high level, and the second switching transistor T2 is switched on to provide the signal of the first power supply terminal VDD to the fifth node N5; the input signal of the second control terminal S2 is at a high level, and the third switching transistor T3 is switched on to provide the signal of the second power supply terminal VSS to the fourth node N4; the inductor L stores the energy. Because the potential of the fifth node N5 is higher than the potential of the fourth node N4, the diode D is in a turn-off state. In this situation, the second switching transistor T2-the inductor L-the driving transistor DTFT-the micro light-emitting diode L-the third switching transistor T3 form a conductive path, and the micro light-emitting diode L emits light.

For example, in the second sub-stage t2, the input signal of the first control terminal S1 and the input signal of the second control terminal S2 are at a low level, the second switching transistor T2 and the third switching transistor T3 are switched off, and the inductor L releases the energy stored in the first sub-stage. Because the potential of the fifth node N5 is lower than the potential of the fourth node N4, the diode D is in a turn-on state. In this situation, the inductor L-the driving transistor DTFT-the micro light-emitting diode L-the diode D forms a closed conductive path, and the micro light-emitting diode L emits light.

It should be noted a count of the first sub-stage and the second sub-stage included in the second stage is not limited to the embodiments of the present disclosure, and some embodiments of the present disclosure are not limited thereto.

For example, in all stages, the signal of the first power supply terminal VDD continues to be at a high level, and the signal of the second power supply terminal continues to be at a low level.

In this embodiment, for example, the signal of the scan signal terminal G1 and the signal of the data signal terminal D1 are pulse signals, and are at high level only in the writing stage. The signal of the first control terminal S1 and the signal of the second control terminal S2 are periodic signals, and are at high level in the first sub-stage.

The average power consumption of a trace of the pixel driving circuit provided by some embodiments of the present disclosure satisfies:

$$P(t) = \frac{\int_{t1}^{t2} I(t)^2 Rt}{t2 - t1} = \frac{I(t)^2 Rt}{T}$$

where I(t) is an instantaneous current flowing through the trace, R is a resistance of the trace, T is a period of the input signal of the first control terminal S1, and t is a time duration when the first control terminal S1 and the second control terminal S2 input turn-on signals within one period T, that is, a time duration when the first switching transistor T1 and the second switching transistor T2 are on.

Because t<T, the average power consumption of the trace of the pixel driving circuit can be effectively reduced in a case where I(t) is not changed. Therefore, the average power of the trace of the pixel driving circuit provided by some embodiments of the present disclosure is less than the average power of the trace of the pixel driving circuit in the prior art, reducing the average power consumption of the trace to t/T of an original average power consumption.

In some examples, for example, the current I(t) flowing through the trace in the first state can be controlled by designing a voltage difference between the first power supply terminal VDD and the second power supply terminal VSS, thereby ensuring the light-emitting effect of the Light-emitting element while storing the energy to the power supply control sub-circuit.

For example, some embodiments of the present disclosure can effectively reduce the average power consumption of the trace by reducing t/T; when reducing t/T, it is necessary to increase an inductance value of the inductance L and reduce the period T of the input signal of the first control terminal S1 to ensure a voltage between the first connection terminal P1 and the second connection terminal P2 (e.g., between the second node N2 and the fourth node N4) of the pixel sub-circuit.

It should be noted that in the description of the various embodiments of the present disclosure, the first node N1, the second node N2, the third node N3, the fourth node N4, and the fifth node N5 do not represent actual components, but rather represent junction points of related circuit connections in the circuit diagram.

Based on the inventive concept of the above embodiments, some embodiments of the present disclosure also provide a display device including the above pixel driving circuit.

Figure 17:
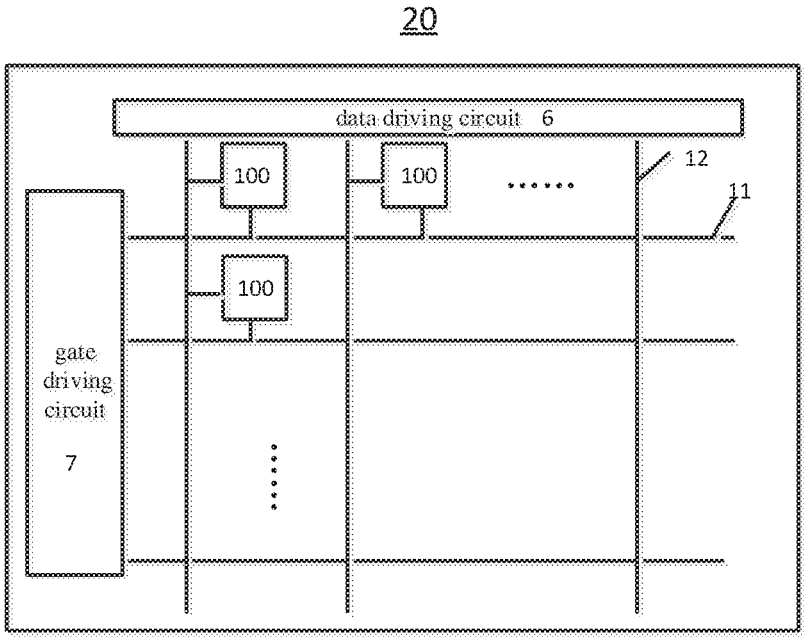
FIG. 17 is a schematic diagram of a display device provided by some embodiments of the present disclosure.

FIG. 17 is a schematic diagram of a display device provided by some embodiments of the present disclosure. As shown in FIG. 17, the display device 20 includes a plurality of pixel units 100 arranged in an array, each pixel unit 100 includes a plurality of sub-pixels to emit light of different colors, and each sub-pixel includes the pixel driving circuit described above.

For example, the display device 20 further includes a plurality of gate lines 11 and a plurality of data lines 12 that cross each other to define a plurality of pixel regions. Each sub-pixel is in one pixel region.

For example, the display device may further include a data driving circuit 6 and a gate driving circuit 7, which are respectively coupled to the pixel unit 100 through a data line 12 and a gate line 11. The data driving circuit 6 is configured to provide data signals, which is used for display operations, to the sub-pixels in the pixel unit 100, and the gate driving circuit 7 is configured to provide scan signals (such as the scan signals described above), which is used for display operations, to the sub-pixels in the pixel unit 100, and may further be used to provide various control signals, power supply signals, etc.

For example, the display device may further include the first power supply terminal VDD and the second power supply terminal VSS, which are described above, to provide power supply voltages (e.g., the first voltage and the second voltage) for each pixel driving circuit.

For example, the display device may be a micro light-emitting diode display device or an organic light-emitting diode display device.

For example, the display device may include a display substrate, and the pixel driving circuit may be on the display substrate.

For example, the display device can be any product or component with display function such as a mobile phone, a tablet computer, a television, a display, a notebook computer, a digital photo frame, a navigator, etc.

Some embodiments of the present disclosure also provide a pixel driving method applied to the pixel driving circuit, the pixel driving method includes: in the first state, providing the first voltage and the second voltage respectively to the first connection terminal and the second connection terminal of the pixel sub-circuit, by the first power supply terminal and the second power supply terminal respectively, and storing the energy, the power supply control sub-circuit; and in the second state, releasing the energy to the first connection terminal and the second connection terminal of the pixel sub-circuit, the power supply control sub-circuit, to drive the light-emitting element to emit light.

In some examples, the driving method includes: in the first state, providing turn-on signals to the first control terminal and the second control terminal to allow the first power supply terminal to provide the first voltage to the first connection terminal of the pixel driving circuit, to allow the second power supply terminal to provide the second voltage to the second connection terminal of the pixel driving circuit, and to allow the power supply control sub-circuit to store the energy; and in the second state, providing a turn-off signal to the first control terminal and the second control terminal to allow the power supply control sub-circuit to release the energy to the first connection terminal and the second connection terminal of the pixel driving circuit to drive the light-emitting element to emit light.

Figure 16:
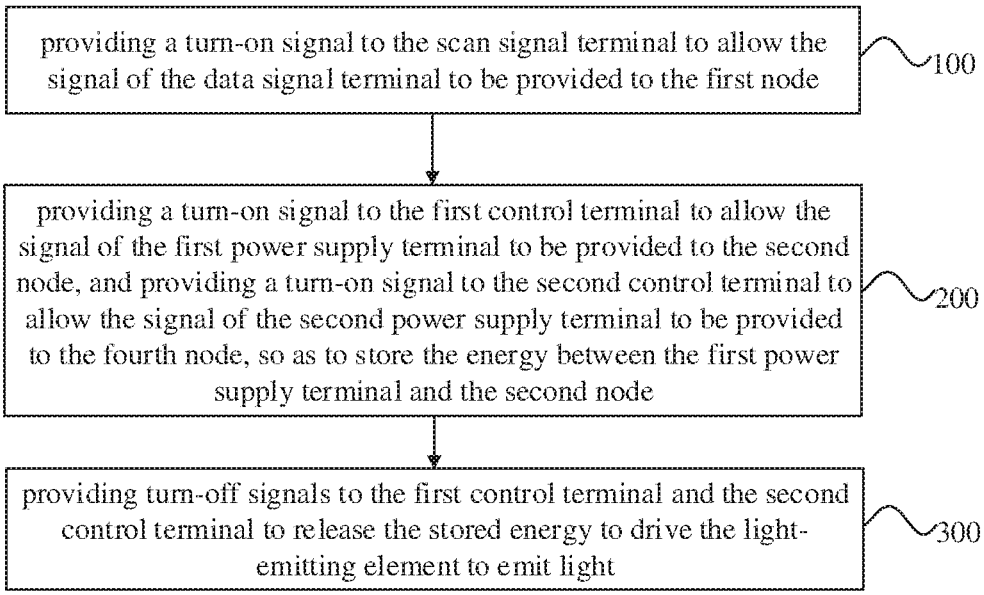
FIG. 16 is a flow chart of a pixel driving method provided by some embodiments of the present disclosure.

FIG. 16 is a flow chart of a pixel driving method provided by some embodiments of the present disclosure. As shown in FIG. 16, the pixel driving method provided by some embodiments of the present disclosure is applied to the pixel driving circuit provided by the embodiment of the present disclosure. The pixel driving circuit includes an input sub-circuit, a first storage sub-circuit, a driving sub-circuit, a light-emitting element and a power supply control sub-circuit, and further includes a scan signal terminal, a data signal terminal, a first power supply terminal and a second power supply terminal, and the pixel driving method specifically includes the following steps.

Step 100: providing a turn-on signal to the scan signal terminal to allow the signal of the data signal terminal to be provided to the first node.

Step 200: providing a turn-on signal to the first control terminal to allow the signal of the first power supply terminal to be provided to the second node, and providing a turn-on signal to the second control terminal to allow the signal of the second power supply terminal to be provided to the fourth node, so as to store the energy between the first power supply terminal and the second node.

Step 300: providing turn-off signals to the first control terminal and the second control terminal to release the stored energy to drive the light-emitting element to emit light.

The pixel driving method provided by some embodiments of the present disclosure includes: providing a turn-on signal to the scan signal terminal to allow the signal of the data signal terminal to be provided to the first node; providing a turn-on signal to the first control terminal to allow the signal of the first power supply terminal to be provided to the second node; providing a turn-on signal to the second control terminal to allow the signal of the second power supply terminal to be provided to the fourth node to store the energy between the first power supply terminal and the second node; providing turn-off signals to the first control terminal and the second control terminal to release the stored energy to drive the light-emitting element to emit light. According to some embodiments of the present disclosure, by controlling the current flowing through the trace between the first power supply terminal and the second power supply terminal, the time duration when the current flows through the trace between the high voltage power supply and the low voltage power supply, can be reduced, thereby reducing the electric energy loss of the trace and saving the electric energy.

In this embodiment, signals provided to the first control terminal and the second control terminal are same and are periodic signals, and periods of the periodic signals are less than a duration of the turn-on signal provided to the scan signal terminal.

The foregoing merely are exemplary embodiments of the disclosure, and not intended to define the scope of the disclosure, and the scope of the disclosure is determined by the appended claims.

What is claimed is:

1. A pixel driving circuit, comprising a pixel sub-circuit and a power supply control sub-circuit, wherein the pixel sub-circuit comprises a first connection terminal, a second connection terminal and a light-emitting element, and is configured to respectively receive a first voltage and a second voltage from the first connection terminal and the second connection terminal to drive the light-emitting element to emit light;

the power supply control sub-circuit is respectively coupled to the first connection terminal, the second connection terminal, a first power supply terminal, and a second power supply terminal; and the power supply control sub-circuit is configured to, in a first state, control the first power supply terminal to provide the first voltage to the first connection terminal of the pixel sub-circuit, control the second power supply terminal to provide the second voltage to the second connection terminal of the pixel sub-circuit, and store energy; and in a second state, release the energy to the first connection terminal and the second connection terminal of the pixel sub-circuit to drive the light-emitting element to emit light, wherein the pixel sub-circuit comprises an input sub-circuit, a first storage sub-circuit and a driving sub-circuit;

the input sub-circuit is respectively coupled to a scan signal terminal, a data signal terminal and a first node, and is configured to provide a signal of the data signal terminal to the first node under control of the scan signal terminal;

the first storage sub-circuit is coupled to the first node and is configured to store the signal of the data signal terminal received by the first node;

the driving sub-circuit is respectively coupled to the first node, a second node and a third node, and is configured to provide a driving current, which is used for driving the light-emitting element, to the third node under control of the first node;

the light-emitting element is respectively coupled to the third node and a fourth node; and the first connection terminal and the second connection terminal are respectively coupled to the second node and the fourth node.

2. The pixel driving circuit according to claim 1, wherein the power supply control sub-circuit further comprises a control sub-circuit, a power supply sub-circuit and a switching sub-circuit;

the control sub-circuit is respectively coupled to the first power supply terminal, the second power supply terminal, a first control terminal, a second control terminal, the fourth node and a fifth node, and is configured to, in the first state, provide the first voltage from the first power supply terminal to the fifth node under control of the first control terminal, and provide the second voltage from the second power supply terminal to the fourth node under control of the second control terminal;

the power supply sub-circuit is respectively coupled to the second node and the fifth node, and is configured to store the energy in the first state and release the stored energy in the second state to drive the light-emitting element to emit light; and the switching sub-circuit is respectively coupled to the fourth node and the fifth node, and is configured to switch off in the first state or switch on in the second state under control of the fourth node and the fifth node.

3. The pixel driving circuit according to claim 2, wherein the control sub-circuit comprises a first control sub-circuit and a second control sub-circuit, the first control sub-circuit is coupled to the first power supply terminal, the fifth node and the first control terminal, and is configured to, in the first state, provide the first voltage from the first power supply terminal to the fifth node under control of the first control terminal; and the second control sub-circuit is coupled to the second power supply terminal, the fourth node and the second control terminal, and is configured to, in the first state, provide the second voltage from the second power supply terminal to the fourth node under control of the second control terminal.

4. The pixel driving circuit according to claim 3, further comprising a second storage sub-circuit, wherein the second storage sub-circuit is respectively coupled to the third node and the fourth node, and is configured to store a voltage difference between the third node and the fourth node.

5. The pixel driving circuit according to claim 2, wherein the control sub-circuit comprises a second switching transistor and a third switching transistor;

a control electrode of the second switching transistor is coupled to the first control terminal, a first electrode of the second switching transistor is coupled to the first power supply terminal, and a second electrode of the second switching transistor is coupled to the fifth node; and a control electrode of the third switching transistor is coupled to the second control terminal, a first electrode of the third switching transistor is coupled to the fourth node, and a second electrode of the third switching transistor is coupled to the second power supply terminal.

6. The pixel driving circuit according to claim 2, wherein the power supply sub-circuit comprises an inductor; and a first terminal of the inductor is coupled to the fifth node, and a second terminal of the inductor is coupled to the second node.

7. The pixel driving circuit according to claim 2, wherein the switching sub-circuit comprises a diode; and an anode of the diode is coupled to the fourth node, and a cathode of the diode is coupled to the fifth node.

8. The pixel driving circuit according to claim 2, further comprising a second storage sub-circuit, wherein the second storage sub-circuit is respectively coupled to the third node and the fourth node, and is configured to store a voltage difference between the third node and the fourth node.

9. The pixel driving circuit according to claim 2, wherein the input sub-circuit comprises a first switching transistor;

a control electrode of the first switching transistor is coupled to the scan signal terminal, a first electrode of the first switching transistor is coupled to the data signal terminal, and a second electrode of the first switching transistor is coupled to the first node;

the first storage sub-circuit comprises a first capacitor;

a first terminal of the first capacitor is coupled to the first node, and a second terminal of the first capacitor is coupled to the second node;

the driving sub-circuit comprises a driving transistor; and a control electrode of the driving transistor is coupled to the first node, a first electrode of the driving transistor is coupled to the second node, and a second electrode of the driving transistor is coupled to the third node.

10. The pixel driving circuit according to claim 1, further comprising a second storage sub-circuit, wherein the second storage sub-circuit is respectively coupled to the third node and the fourth node, and is configured to store a voltage difference between the third node and the fourth node.

11. The pixel driving circuit according to claim 10, wherein the second storage sub-circuit comprises a second capacitor; and a first terminal of the second capacitor is coupled to the third node, and a second terminal of the second capacitor is coupled to the fourth node.

12. The pixel driving circuit according to claim 1, wherein the input sub-circuit comprises a first switching transistor;

a control electrode of the first switching transistor is coupled to the scan signal terminal, a first electrode of the first switching transistor is coupled to the data signal terminal, and a second electrode of the first switching transistor is coupled to the first node;

the first storage sub-circuit comprises a first capacitor;

a first terminal of the first capacitor is coupled to the first node, and a second terminal of the first capacitor is coupled to the second node;

the driving sub-circuit comprises a driving transistor; and a control electrode of the driving transistor is coupled to the first node, a first electrode of the driving transistor is coupled to the second node, and a second electrode of the driving transistor is coupled to the third node.

13. The pixel driving circuit according to claim 1, further comprising a second storage sub-circuit, wherein the input sub-circuit comprises a first switching transistor; the first storage sub-circuit comprises a first capacitor; the driving sub-circuit comprises a driving transistor; the power supply control sub-circuit comprises a second switching transistor, an inductor, a third switching transistor and a diode; and the second storage sub-circuit comprises a second capacitor;

a control electrode of the first switching transistor is coupled to the scan signal terminal, a first electrode of the first switching transistor is coupled to the data signal terminal, and a second electrode of the first switching transistor is coupled to the first node;

a first terminal of the first capacitor is coupled to the first node, and a second terminal of the first capacitor is coupled to the second node;

a control electrode of the driving transistor is coupled to the first node, a first electrode of the driving transistor is coupled to the second node, and a second electrode of the driving transistor is coupled to the third node;

a control electrode of the second switching transistor is coupled to the first control terminal, a first electrode of the second switching transistor is coupled to the first power supply terminal, and a second electrode of the second switching transistor is coupled to the fifth node;

a first terminal of the inductor is coupled to the fifth node, and a second terminal of the inductor is coupled to the second node;

a control electrode of the third switching transistor is coupled to the second control terminal, a first electrode of the third switching transistor is coupled to the fourth node, and a second electrode of the third switching transistor is coupled to the second power supply terminal;

an anode of the diode is coupled to the fourth node, and a cathode of the diode is coupled to the fifth node; and a first terminal of the second capacitor is coupled to the third node, and a second terminal of the second capacitor is coupled to the fourth node.

14. The pixel driving circuit according to claim 1, wherein the light-emitting element comprises a micro light-emitting diode.

15. A display device, comprising a plurality of pixel driving circuits according to claim 1.

16. A pixel driving method, applied to the pixel driving circuit according to claim 1, comprising:

in the first state, providing the first voltage and the second voltage respectively to the first connection terminal and the second connection terminal of the pixel sub-circuit, by the first power supply terminal and the second power supply terminal, and storing the energy, by the power supply control sub-circuit; and in the second state, releasing the energy to the first connection terminal and the second connection terminal of the pixel sub-circuit, by the power supply control sub-circuit, to drive the light-emitting element to emit light.

17. The pixel driving method according to claim 16, wherein in a case where the power supply control sub-circuit is coupled to a first control terminal and a second control terminal respectively, the driving method further comprises:

in the first state, providing turn-on signals to the first control terminal and the second control terminal to allow the first power supply terminal to provide the first voltage to the first connection terminal of the pixel driving circuit, to allow the second power supply terminal to provide the second voltage to the second connection terminal of the pixel driving circuit, and to allow the power supply control sub-circuit to store the energy; and in the second state, providing turn-off signals to the first control terminal and the second control terminal to allow the power supply control sub-circuit to release the energy to the first connection terminal and the second connection terminal of the pixel driving circuit to drive the light-emitting element to emit light.

18. The pixel driving method according to claim 17, wherein in a case where the pixel sub-circuit comprises an input sub-circuit, the input sub-circuit is respectively coupled to a scan signal terminal, a data signal terminal and a first node, and is configured to provide a signal of the data signal terminal to the first node under control of the scan signal terminal;

the driving method further comprises: providing a turn-on signal to the scan signal terminal to allow the signal of the data signal terminal to be provided to the first node, wherein signals provided to the first control terminal and the second control terminal are same and are periodic signals, and periods of the periodic signals are less than a duration of the turn-on signal provided to the scan signal terminal.

19. The pixel driving circuit according to claim 1, wherein the power supply control sub-circuit further comprises a control sub-circuit, a power supply sub-circuit and a switching sub-circuit;

the control sub-circuit is respectively coupled to the first power supply terminal, the second power supply terminal, a first control terminal, a second control terminal, the fourth node and a fifth node, and is configured to, in the first state, provide the first voltage from the first power supply terminal to the fifth node under control of the first control terminal, and provide the second voltage from the second power supply terminal to the fourth node under control of the second control terminal;

the power supply sub-circuit is respectively coupled to the second node and the fifth node, and is configured to store the energy in the first state and release the stored energy in the second state to drive the light-emitting element to emit light; and the switching sub-circuit is respectively coupled to the fourth node and the fifth node, and is configured to switch off in the first state or switch on in the second state under control of the fourth node and the fifth node.

* * * * *